United States Patent [19]

Morris et al.

[11] Patent Number: 4,718,577

[45] Date of Patent: Jan. 12, 1988

[54] SUSPENDABLE DISPENSER PACK CONTAINER FOR FLOWABLE SUBSTANCES, SUCH AS LIQUIDS, PASTES, POWDER AND FINE GRANULES

[75] Inventors: David B. Morris; Andrew C. Rollett; Donald M. Roberts, all of Bury St. Edmunds; Christopher D. Emmerson, Sutton, all of United Kingdom

[73] Assignee: Bayer Aktiengesellschaft, Leverkusen, Fed. Rep. of Germany

[21] Appl. No.: 882,668

[22] Filed: Jul. 7, 1986

[30] Foreign Application Priority Data

Jul. 26, 1985 [GB] United Kingdom ..... 8518942

[51] Int. Cl.[4] ..... B65D 33/06; B67D 5/64

[52] U.S. Cl. ..... 222/105; 222/181; 222/185; 222/131

[58] Field of Search ..... 222/105, 181, 131, 183, 222/185, 92, 173, 180; 248/95, 108; 383/9, 24; 220/403

[56] References Cited

U.S. PATENT DOCUMENTS

| | | | |
|---|---|---|---|
| 3,433,400 | 3/1969 | Hawkins | 222/185 X |
| 3,913,789 | 10/1975 | Miller | 222/107 |
| 3,924,781 | 12/1975 | Witte | 222/181 X |
| 3,930,286 | 1/1976 | McGowen | 222/105 X |
| 4,165,024 | 8/1979 | Oswalt et al. | 222/181 X |
| 4,247,021 | 1/1981 | Renier et al. | 222/183 X |
| 4,378,069 | 3/1983 | Franco | 222/107 X |
| 4,564,127 | 1/1986 | Garabedian et al. | 222/105 X |

*Primary Examiner*—Joseph J. Rolla
*Assistant Examiner*—Nils Pedersen
*Attorney, Agent, or Firm*—Sprung Horn Kramer & Woods

[57] ABSTRACT

A suspendable dispenser pack container for flowable substances, such as liquids, pastes, powders and fine granules, made up of an outer carton (1) and bag (3) fitted inside it. The bag (3) has at its top end a loop (25), through which a tube (22) is placed, which together with the loop (25) is positioned in relation to a location aperture (12) at the same point in the side wall (11) of the outer carton (1). The bag (3) has at the bottom end a connector (38) and is of such a length that when the base (5) of the outer carton (1) is open, the connector (38) protrudes at least as far as the opened flaps (6, 7, 8, 9) of the outer carton (1).

11 Claims, 8 Drawing Figures

SUSPENDABLE DISPENSER PACK CONTAINER FOR FLOWABLE SUBSTANCES, SUCH AS LIQUIDS, PASTES, POWDER AND FINE GRANULES

BACKGROUND OF THE INVENTION

The invention concerns a suspendable dispenser pack container for flowable substances, such as liquids, pastes, powder and fine granules, particularly of expensive substances requiring secure packaging, consisting of a bag which in a filled state has a connector sealed with a film and an outer carton which is closed with flaps.

SUMMARY OF THE INVENTION

The objective was to make a pack container of the type above, which can be emptied by hanging on a general purpose built device and which can be attached to an emptying pipe. It must also serve as a transportable container and must therefore be secure enough and after emptying it must be easily disposed of, for example by burning.

The problem was solved by having a suspension loop at the top end of the bag, through which a tube is disposed; the connector is disposed at the lower end of the bag in one of the bag walls; the interior of the bag is generally conically shaped down towards the connector; the outer carton, in the region of the longitudinal axis of the loop and tube, has a locating aperture on one side at least, serving to hold the loop and tube in alignment with the locating aperture; where the length of the bag from the longitudinal axis of the loop and tube to the connector in an empty as well as a filled state is longer than the length of the closed carton from the bottom to the longitudinal axis of the locating aperture, loop and tube, so that when hanging with the base of the outer carton open, the connector protrudes at least as far as the opened flaps of the outer carton. Preferably, to increase the security of location of the tube, flange(s) are provided at one or both ends of the tube to locate with corresponding slots on one or both ends of an inner strengthening shell.

Thus the pack container can be placed on a rod on the general purpose made equipment, so that the rod passes through the locating hole into the tube. Naturally the diameter of the rod and the inner diameter of the tube and the locating hole must correspond to each other. Good positioning is achieved when there is only a marginal difference between the diameters. Then, however sliding the tube onto the rod is quite difficult, as it is when the tube is conically tapered from the point of entry. If the inside diameter of the tube is a little larger, than a close fit, the rod locates more readily. After locating the tube on the rod, the bottom of the outer carton should be opened so that the bag falls out of the outer carton until the weight pulls the loop tight against the tube. The length chosen is such that the connector falls to the area of the opened flaps, so there will be no difficulty fixing a pipe to it. Of course the connector may be fitted with a protective cap, which would be removed before connection of the pipe.

The pipe should preferably be fitted with a connecting coupling which will pierce the film seal at the opening of the connector. Because of the conical shape of the lower end of the bag down to the connector, the bag empties well. As the outer carton and bag are usually made of combustible material disposal of the pack container is no problem.

The top end of the bag should preferably also be diagonally finished but this is not essential. However emptying and fitting the bag into the outer carton in a filled state is better when the bag is so shaped.

According to a particular embodiment, a strengthening shell is provided between the bag and the outer carton. This shell will have at least one locating hole at the height of the loop and tube.

This strengthening shell will help in the protection of the bag. It can of course be provided with flaps at one or both ends, so that an internal and external outer carton are present.

The locating hole in the strengthening shell should preferably correspond to the external diameter of the tube and the end of the tube is positioned in this locating hole.

In this way the strengthening shell, i.e. its locating hole is used to position and centre the tube. Of course centralisation is particularly good when the strengthening shell has a hole at both ends. When both ends of the tube are stowed, the positioning is positive.

According to a further preferred embodiment it is desirable for the tube to have a flange on one or, preferably both ends.

If a strengthening shell is being used, the flange on each end of the tube can be positioned between the strengthening shell and the outer carton and the tube will then be fastened firmly.

The locating aperture in the strengthening shell should preferably take the form of an open slot.

In this way one can insert the tube through the loop of the possibly already filled bag and can hang it from above in the aperture of the strengthening shell. With this embodiment it is particularly advantageous to have a flange on both ends of the tube, because then the tube is held firmly and even better located. If the width of the slot is slightly smaller than the diameter of the tube and the actual stowage point of the tube in the strengthening shell, this will act as further security for the positioning of the tube.

Outer carton and strengthening shell can usually follow normal commercial designs, for example being made of tough board or corrugated board. The outer carton should be suitably protected by additives to the board against moisture and wet.

The walls of the bag should preferably—from outside to inside—be made up of a minimum of one layer of laminated sheet film with an outer layer of aluminium and a synthetic inner layer as well as a further layer of synthetic sheet film where the inner layer of the bag and the loop are bordered by heat-sealed seams.

Such a pack offers the required security for the packing of expensive substances, is easily manufactured and also easily disposed of. Of course the connector should preferably also be heat sealed in. It has proved practical to use a rectangle shaped bag, even though the actual, useable inner layer of the bag is heat sealed diagonally across two or four corners. When the rectangular shape is sealed all the way round, this gives extra security and should one of the diagonal heat seams split, there is an additional safeguard against leakage.

In order to achieve particularly strong walls, it is better to use two layers of flat laminated film.

The drawing shows a preferred embodiment of the new pack container of the invention which can be emptied by being suspended. In the drawings:

DETAILED DESCRIPTION OF THE INVENTION

Figure 1:
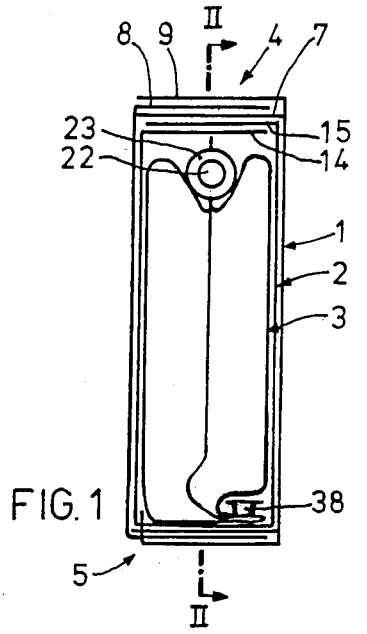
FIG. 1, shows a schematic vertical section of a pack container in a full and closed state.
Figure 2:
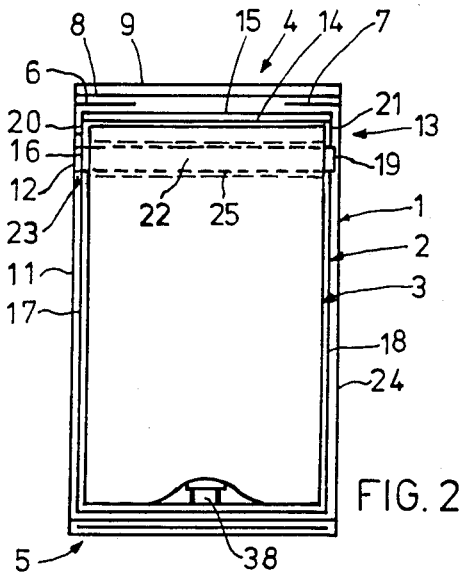
FIG. 2, shows a section on line II—II of FIG. 1.
Figure 3:
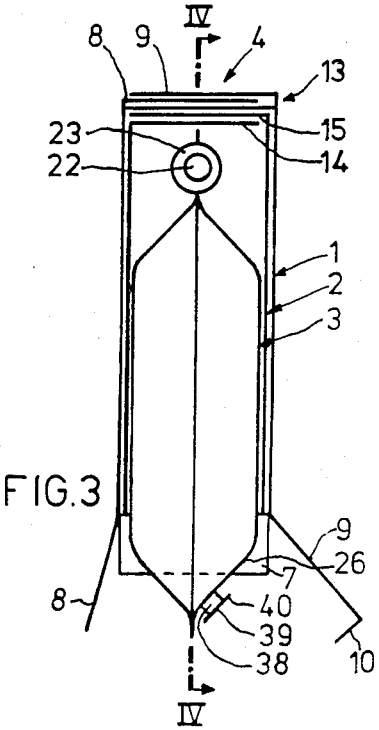
FIG. 3, shows a similar view to that of FIG. 1 with the pack container in full but ready to empty state through the opened outer carton.
Figure 4:
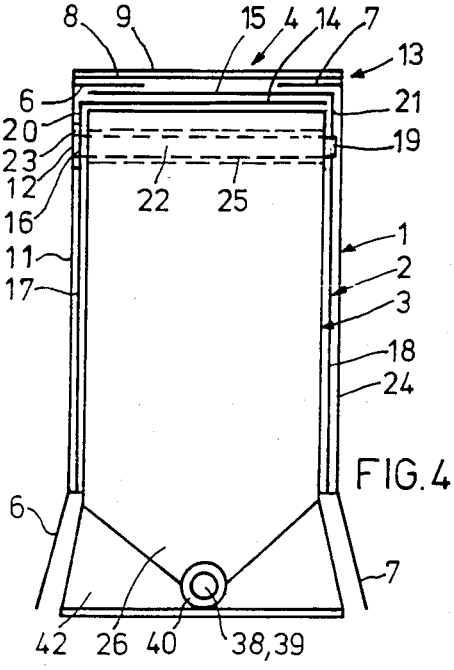
FIG. 4 shows a section on line IV—IV of FIG. 3.
Figure 5:
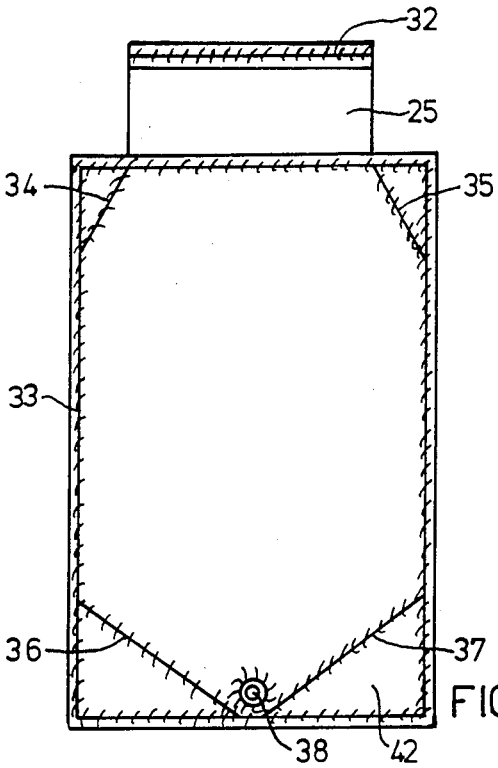
FIG. 5 shows a section of the bag in an empty, flat state.
Figure 6:
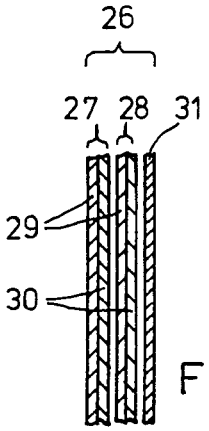
FIG. 6 shows the construction of the bag wall enlarged.
Figure 7:
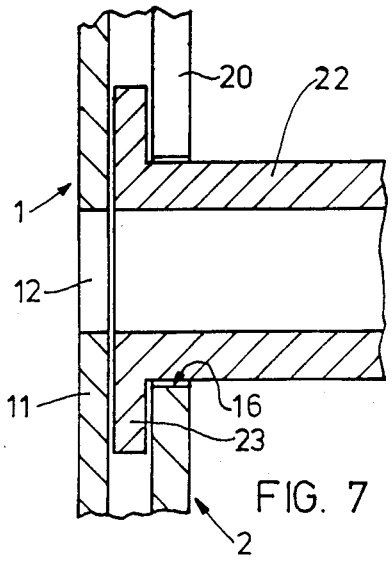
FIG. 7*a* shows a section through the locating position of the tube, enlarged.
Figure 8:
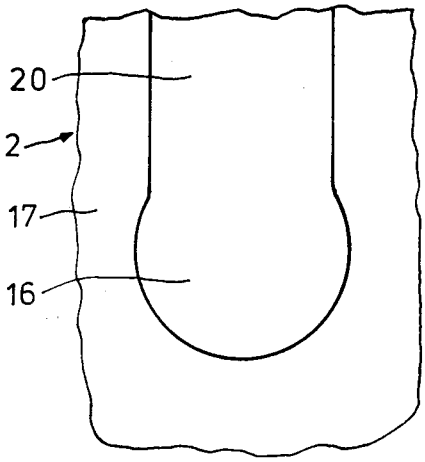
FIG. 8 shows the arrangement of the slot in the strengthening shell, enlarged.

Referring now to FIGS. 1-4, in an outer carton 1 there is a strengthening shell 2 and a bag 3. The outer carton 1 has a rectangular cross section and at the ends 4, 5 which are formed by two side flaps 6, 7, an inner flap 8 and an outer flap 9. At the end 5, flap 9 has a tuck-in flap 10. The outer carton 1 also has, towards the top end 4, a small aperture 12 shaped like a round hole in the side wall 11. The strengthening shell 2 is tightly fitted into the outer carton 1. The strengthening shell has an upper end 13 with an inner flap 14 and an outer flap 15. The strengthening shell 2 also has an aperture 16 in the side wall 17 which correspoonds to aperture 12. In the opposite side wall 18 of the strengthening shell 2 an aperture 19 is located on the same axis. The apertures 16, 19 have slots 20, 21 opening upwards, where the width of these slots 20, 21 is slightly smaller than the diameter of the actual apertures 16, 19 (FIG. 7, 8). A tube 22 made of polypropylene is located in these apertures 16, 19. The external diameter of the tube corresponds to the internal diameter of the apertures 16, 19. On one or, preferably, both ends of the tube 22 there is a flange 23, positioned between the outer carton 1 and the strengthening shell 2 between the apertures 12 and 16 as shown in FIG. 7. Thus the tube 22 is safely positioned against movement. The other end of the tube 22 is placed in the aperture 19 and lies against the side wall 24 of the outer carton 1; as indicated, this end too may have a flange. The bag 3 has at its top end a loop 25, through which the tube 22 is retained. The wall 26 of the bag 3 comprises—from outside to inside—two, as shown in FIG. 6 similar laminated sheet films 27, 28 each with an external aluminium layer 29, onto which a polyethylene sheet film 30 of 0.012 mm thickness is sealed and an inner polyethylene sheet film 31 of 0.075 mm thickness. The films 27, 28, 31 are joined by heat seams 32, 33, 34, 35, 36, 37 as shown as FIG. 5. At the bottom end of the bag 3 a connector 38 has also been heat sealed into the wall 28. It is sealed with a film 39 and has a flange 40. The intended cap is not shown. The size of the section of bag 3 (FIG. 5) corresponds largely with the inner size of the strengthening shell 2. The heat seam 32 forms the loop 25. Heat seam 33 runs around the edge of the interior 41. The heat seams 34, 35, which may be present, run diagonally across the top corners of the interior 41 and the heat seams 36, 37 run diagonally across to the connector 38 and facilitate emptying. The sealed off corners 42 in the bag 3 are left and serve to stiffen and strengthen the bag.

In this specification, terms such as "top" refer to the orientation of the pack container in its orientation for use, as shown in the drawings.

We claim:

1. A suspendable dispenser pack container for high value, flowable substances, such as liquids, pastes, powders and fine granules, comprising: a bag which in a filled state has a connector sealed with a foil and a outer carton which is closed by flaps which at a top end of the bag is provided with a hanging loop through which a tube is disposed, wherein the connector is disposed at a lower end of the bag in one of the bag walls, the interior of the bag runs generally conically at the bottom to the connector; wherein the outer carton in the region of the longitudinal axis of the loop and tube has a locating aperature on at least one side and through which one end of the tube is disposed to hold the loop and tube in alignment with the locating aperture; the length of the bag from the longitudinal axis of the loop and tube to the connector in an empty as well as in the filled state, is longer than the height of the closed outer carbon from the bottom to the longitudinal axis of the locating aperture, loop and tube, whereby when hanging and with the base of the outer carton open, the connector protrudes at least as far as the opened flaps of the outer carton.

2. A pack container according to claim 1, wherein the top end of the bag has diagonal corners.

3. A pack container according to claim 1 or 2, wherein between the bag and the outer carton, there is a strengthening shell, which has at least one aperture at the height of the loop and tube.

4. A pack container according to claim 3, wherein the at least one aperture in the strengthening shell fits the external diameter of the tube and the end of the tube is positioned in said at least one aperture.

5. A pack container according to claim 4, wherein each aperture in the strengthening shell comprises an open slot.

6. A pack container according to claim 5, wherein the tube has a flange on at least one end.

7. A pack container according to claim 6, wherein the flange of the tube is fitted between the strengthening shell and the outer carton.

8. A pack container according to claim 5 wherein the tube has flanges at both ends for location with corresponding slots in the strengthening shell.

9. A pack container according to claim 1, wherein the walls of the bag from outside to inside comprise a minimum of one layer of laminated sheet film, comprising an outer layer of aluminum and an inner layer of a synthetic material, as well as further layer of synthetic sheet film, where the interior of the bag and the loop are bordered by heat-sealed seams.

10. A pack container according to claim 9, wherein the walls have two layers of flat laminated sheet film.

11. A pack container according to claim 10, wherein the cross section of the bag is rectangular and has a heat-sealed seam around the outside.

* * * * *